US005257765A

United States Patent [19]

Halle

[11] Patent Number: 5,257,765

[45] Date of Patent: Nov. 2, 1993

[54] BEVERAGE CONTAINER HOLDER AND TRAY FOR MOUNTING TO TUBULAR CHAIR LEG

[76] Inventor: Robert L. Halle, 2009 Mermaid, El Paso, Tex. 79936

[21] Appl. No.: 877,656

[22] Filed: May 1, 1992

[51] Int. Cl.[5] ..... A47K 1/08

[52] U.S. Cl. ..... 248/222.1; 248/222.3; 248/230; 248/231.5; 248/311.2

[58] Field of Search ..... 248/218.4, 222.1, 222.2, 248/222.3, 225.31, 231.5, 230, 289.1, 311.2; 220/475

[56] References Cited

U.S. PATENT DOCUMENTS

| | | | |
|---|---|---|---|
| 3,008,679 | 11/1961 | Powell | 248/311.2 |
| 3,638,894 | 2/1972 | Leutenegger | 248/230 X |
| 4,063,701 | 12/1977 | Wray | 248/225.31 X |
| 4,071,175 | 1/1978 | Wagnon | 248/311.2 X |
| 4,213,649 | 7/1980 | Sell | 248/311.2 X |
| 4,560,128 | 12/1985 | Willeby et al. | 248/311.2 X |
| 4,878,642 | 11/1989 | Kirby, Jr. | 248/311.2 |
| 4,953,819 | 9/1990 | Davis | 248/230 |
| 4,998,700 | 3/1991 | McKaig | 248/311.2 X |
| 5,007,612 | 4/1991 | Manfre | 248/311.2 X |
| 5,143,337 | 9/1992 | Tomayko, Jr. et al. | 248/311.2 |

*Primary Examiner*—David A. Scherbel
*Assistant Examiner*—Derek J. Berger
*Attorney, Agent, or Firm*—Gunn, Lee & Miller

[57] ABSTRACT

A molded apparatus having a generally cylindrical beverage container holder and sunken tray which mounts securely to variable sizes of tubular chair legs, the beverage container holder having a notch on the outer side for accommodation of beverage containers with handles. The apparatus additionally has two hooks which secure the apparatus to the chair leg, one hook being rotatable for adjustment to the particular slant of the leg, and a supporting arm for bracing and maintaining the apparatus in an aligned position with the side of the chair.

4 Claims, 3 Drawing Sheets

BEVERAGE CONTAINER HOLDER AND TRAY FOR MOUNTING TO TUBULAR CHAIR LEG

BACKGROUND OF THE INVENTION

1. Field of The Invention

The present invention relates generally to the retaining of beverage containers, snacks and other miscellaneous items by a combination beverage container holder and snack tray, more specifically to such retaining by a molded combination plastic beverage container holder and snack tray which mounts to the tubular leg of a chair and allows for adjustment to the slant of the leg.

2. Background Information

Portable chairs, particularly lawn chairs, are often used during outdoor relaxation or during outdoor activities such as barbecues, camping trips, and sporting events. At these times, people frequently carry beverages in containers such as cans, cups, and bottles, plus snacks, cameras, glasses, jewelry, and other items. It is not unusual to witness the people carrying these items struggling to balance them on a nearby rock or stump, the arm of the lawn chair, or between their knees. After unsuccessful balancing attempts, these beverage containers, snacks, and other various items are often placed on the ground only to be lost, kicked, trampled, or invaded by insects and animals. In an effort to forego these balancing acts or to salvage unlucky remains, bulky tables, boxes or make-shift substitutes are dragged and carried inconveniently from storage or their normal location.

In response to this problem, portable tables, ice chests, satchels, and other carry-along alternatives were introduced onto the market. Although potential choices, these alternatives usually prove frustrating since the desired items are not easily within reach but are hidden from view and/or are intermingled with other items. Additionally, those choices that do allow for easy reach and visibility are often clumsy and burdensome to transport.

In response to a similar problem encountered by car travelers, beverage container and article holders which ride on the center console or attach to the dashboard of a vehicle were also introduced onto the market. Although appropriate for use when driving, these holders do not adapt to other situations or to other needs.

The present invention offers a small, easily portable, secure holder for beverage containers, snacks, and other miscellaneous items, which quickly and conveniently attaches to the tubular leg of a chair.

A primary purpose of the invention is to provide a beverage container and snack tray that has a unique adjustment and insert design so it will adapt to various angles and diameters of chair legs, providing stable and secure support for beverage containers, snacks, and other miscellaneous items.

An additional purpose of the invention is to provide a convenient and inexpensive way to enjoy the outdoors without having to place beverage containers, snacks or other items on the ground or a table.

Other purposes and advantages will become apparent from the following description when considered in the light of the attached drawings.

SUMMARY OF THE INVENTION

The present invention is a small, easily portable, secure holder for beverage containers, snacks, and other miscellaneous items, which quickly and conveniently attaches to the tubular leg of a chair. The beverage container holder is a cylindrical well which keeps the beverage containers in a generally vertical and upright position. The rectangular tray, which is connected to the beverage container holder, is slightly sunken, providing a convenient location for a variety of loose items. Also connected to the beverage container holder are two vertically spaced hooks which secure the beverage container holder and tray to the leg of the chair. While the hooks secure the apparatus to the leg of the chair, an L-shaped support arm, which is connected to the rectangular tray, braces the apparatus against the side of the chair so that the beverage container holder and tray maintain a generally horizontal position.

DESCRIPTION OF THE PREFERRED EMBODIMENT

Figure 1:
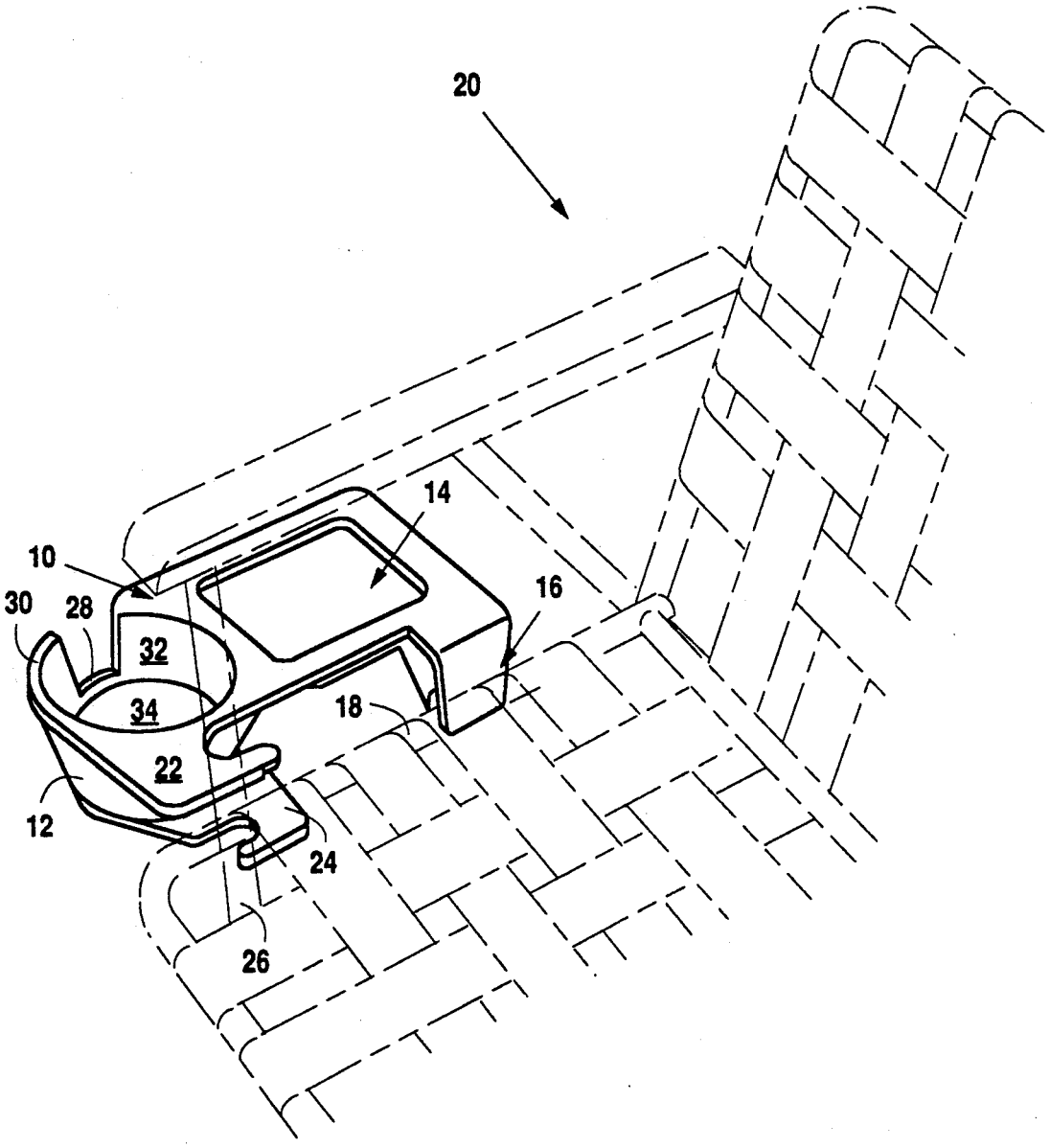
FIG. 1 is a perspective view of the invention as it appears when attached to the right front leg of a lawn chair.

Referring to FIG. 1, the plastic molded combination beverage container holder and snack tray 10 of the present invention has a beverage container well 12, a snack tray 14 and an L-shaped support arm 16 which braces the apparatus 10 against the horizontal rung 18 of the lawn chair 20. The beverage container holder and snack tray 10 is attached to the lawn chair 20 by means of a top stationary hook 22 and a bottom movable hook 24 which are vertically spaced and opposed and which fit around the tubular leg 26 of the lawn chair 20.

The beverage container well 12 has a U-shaped notch 28 so that the beverage container well 12 may accommodate beverage containers with a handle. The U-shaped notch 28, located on the side of the well 12 opposite the hooks 22 and 24, begins at the top 30 of the beverage container well 12 and continues approximately three quarters of the way down the side wall 32 of the beverage container well 12 or slightly above the bottom 34 of the well 12.

Figure 2:
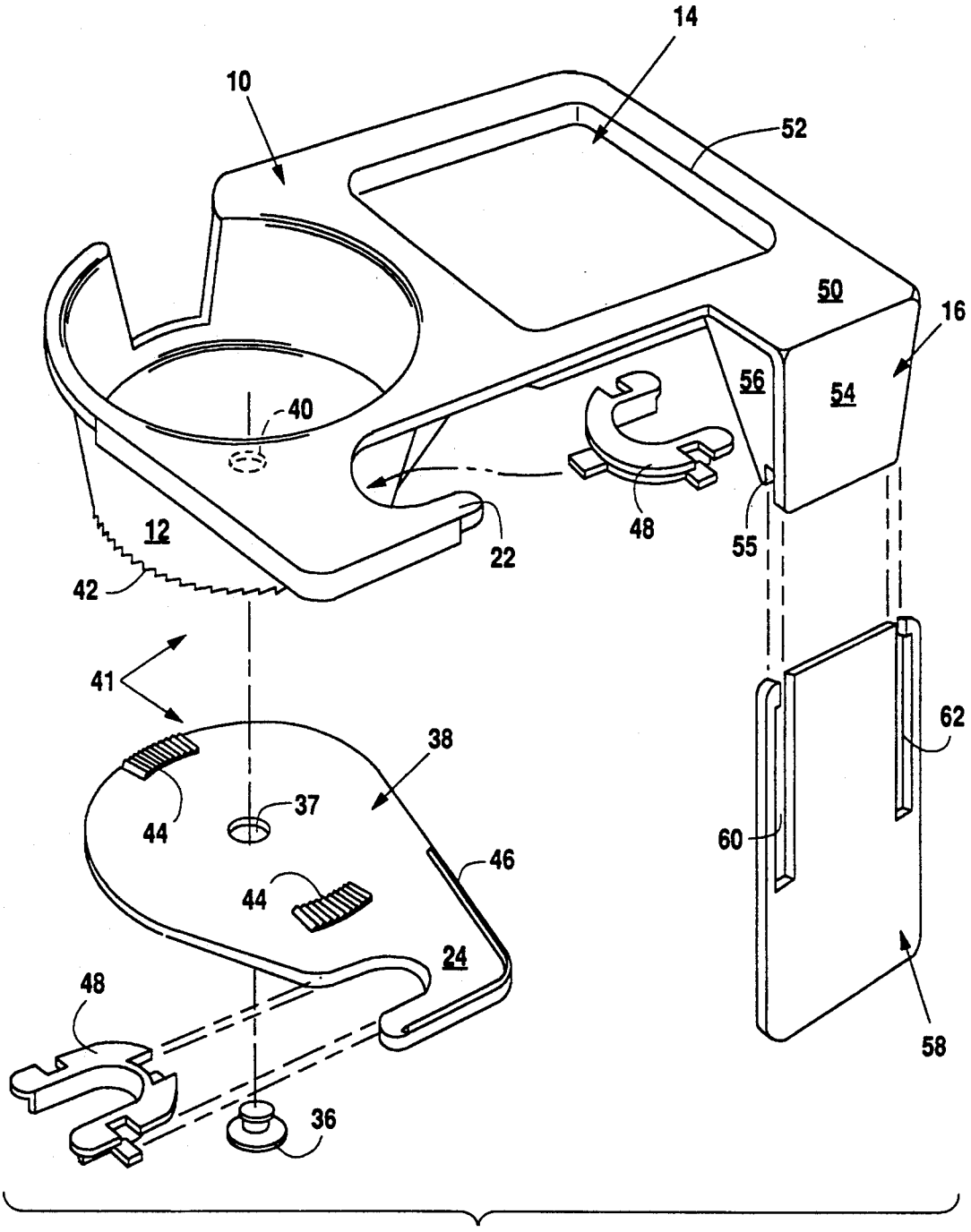
FIG. 2 is an exploded perspective view of the invention.

Referring to FIG. 2, the exploded perspective view shows an axle 36 which extends through an orifice 37 in bottom plate 38 and through orifice 40 in the bottom or underside of the well 12. Plate 38 is capable of rotating about the axis of axle 36. To ensure only clockwise rotation, a ratchet assembly 41 is formed by two sets of opposing teeth 42 and 44. The first set of teeth 42 extend circumferentially around and are molded to the bottom of well 12 of the beverage container holder 12. The second set of teeth 44 is composed of two adjacently positioned individual clusters of teeth which work in cooperation to oppose the first set of teeth 42 on the bottom of well 12 and are molded to the top surface of plate 38 so that when clockwise pressure is asserted against the side reinforcement 46 of the bottom hook 24, the second set of teeth 44 slip over the first set of teeth 42 allowing rotation around the axle 36. These opposing teeth 42 and 44 enable clockwise rotation of the rotatably affixed movable bottom hook 24 until appropriate positioning is achieved to adapt the beverage container holder and snack tray 10 to different chair legs. This adjustment feature of movable bottom hook 24, enabling adaptation of the beverage container holder and snack tray 10 to most lawn chairs, is essential since lawn chairs legs typically have different slants.

The opposing teeth have one face that is 90 degrees from their base and a slanted face or hypotenuse that is angled at approximately 30 degrees from their base such that the upper and lower rings of teeth 42 and 44 mesh. When clockwise pressure is asserted on the bottom hook 24, the slanted faces of the opposing teeth slip over each other. When stopped in a meshed or flush position, the 90 degree faces directly oppose one another, preventing any counterclockwise movement subsequently providing a method of locking the bottom hook 24 in place. The triangular shape of the opposing teeth 42 and 44 prohibit counterclockwise rotation, as is well known in the art, ensuring steady and stable support for weight placed in the beverage container holder 12 or on the snack tray 14.

FIG. 2 additionally shows plastic molded inserts 48 that slip firmly by an interference fit into the top stationary and bottom movable hooks 22 and 24 respectively. These optional inserts 48 function as spacers and effectively reduce the interior diameter of the hooks 22 and 24, providing a beverage container holder and snack tray 10 that adjusts to the particular diameter of the tubular chair leg.

Also visible in FIG. 2 is the L-shaped support arm 16 or bracket assembly which braces the beverage container holder and snack tray 10 against the horizontal rung 18 of the lawn chair 20 (not shown in FIG. 2). This arm 16 consists of a horizontal segment 50 extending from the exterior perimeter 52 of the snack tray 14, and a vertical segment or leg 54 for the L-shaped support arm 16 attaching to the horizontal segment 50 in a generally perpendicular manner. Two triangular plates or struts 56 fit into the 90 degree angle formed by the horizontal and vertical segments 50 and 54 of the bracing arm 16.

If the desired attachment position is beyond the reach of the L-shaped support arm 16, a flat rectangular sheet or vertical extension piece 58 may be attached. The vertical extension piece 58 is a molded rectangular piece of plastic that has two narrow vertical slots 60 and 62 located in a position such that the vertical extension piece 58 slides over the triangular struts or supports 56 and engages the slots 60 and 62. The vertical extension piece 58 slides along the inner face of the vertical segment 54, the sides of the vertical extension piece 58 flexing slightly and fitting around the triangular struts 56, until the vertical extension piece 58 has slid the entire length of the vertical segment 54. The vertical extension 58 fits snugly in space 64, shown in FIG. 3, formed by the vertical segment 54 of the bracing arm 16 and a small ridge 66, also shown in FIG. 3, on the underside of the horizontal segment 50. Rectangular notches 55 provide lateral support for the vertical extension 58, securing the vertical extension 58 tightly against the vertical segment 54. The vertical extension 58, being longer than the vertical segment 54 of the bracing arm 16, provides an extension to the original vertical segment 54 and braces the beverage container holder and snack tray 10 against the horizontal rung 18 (in FIG. 1) of the lawn chair seat. Vertical extension 58 is particularly useful when the vertical hooks 22 and 24 are attached to the tubular leg 26 above seat 18, vertical extension 58 ensuring that the beverage container holder and snack tray 1 is securely braced against seat 18.

Figure 3:
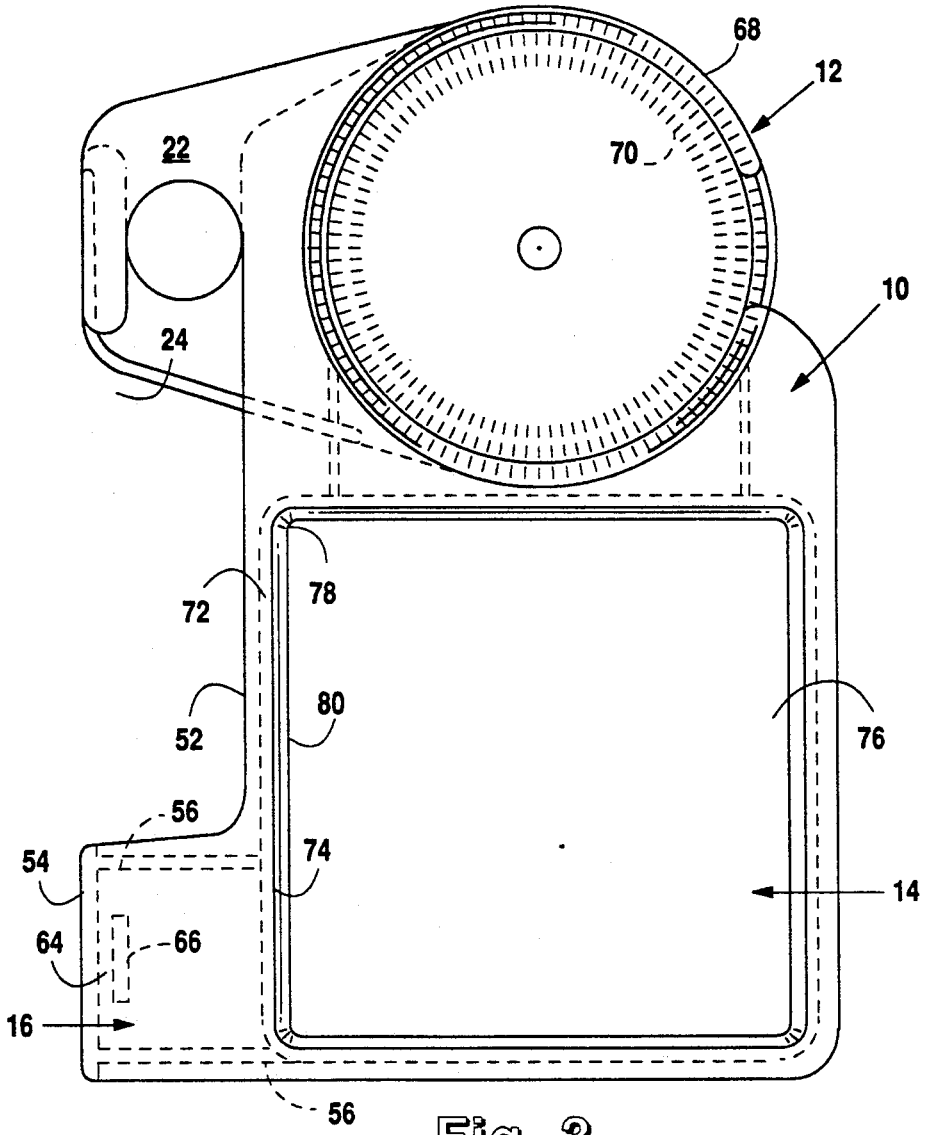
FIG. 3 is a top plan view of the invention.

FIG. 3 is a top plan view of the plastic molded beverage container holder and snack tray 10 as it may appear when the bottom hook 24 is rotated into a position such that the top and bottom hooks 22 and 24 respectively fit securely around the tubular leg 26 (in FIG. 1) of a lawn chair 20 (in FIG. 1). The beverage well 12 is shaped such that the top perimeter 68 of the beverage container well 12 is slightly larger than the base perimeter 70 of the beverage container well 12. This taper allows for secure retention of a beverage container as the bottom of a beverage container will fit closely within the base perimeter 70 of the beverage holder 12 while the slightly larger top perimeter 68 allows for easy insertion and removal of a beverage container.

The rectangular snack tray 14 has an upstanding ridge 72 formed by exterior perimeter 52 and the upper interior perimeter 74 of the snack tray 14 such that loose articles such as snacks, pens, jewelry, glasses, etc. . . placed on the recessed floor 76 of the snack tray 14 will not fall or slide off the snack tray 14. The rounded corners 78 of the lower interior perimeter 80, the upper interior perimeter 74, and the exterior perimeter 52 provide a smooth and aesthetically pleasing location for snacks and other miscellaneous items.

Also seen in FIG. 3, L-shaped support arm 16 is supported by two triangular struts 56. The ridge 66, located between the two triangular struts 56, provides a means for securing the optional vertical extension 58 (shown in FIG. 2) against the vertical segment 54. The location of the ridge 66 allows for a space 64 in which the vertical extension 58 may be snugly inserted. Adequate support for the vertical extension 58 is necessary so that there is sufficient bracing for the beverage holder and snack tray 10 against the horizontal rung 18 of the lawn chair 20 (as shown in FIG. 1).

Figure 4:
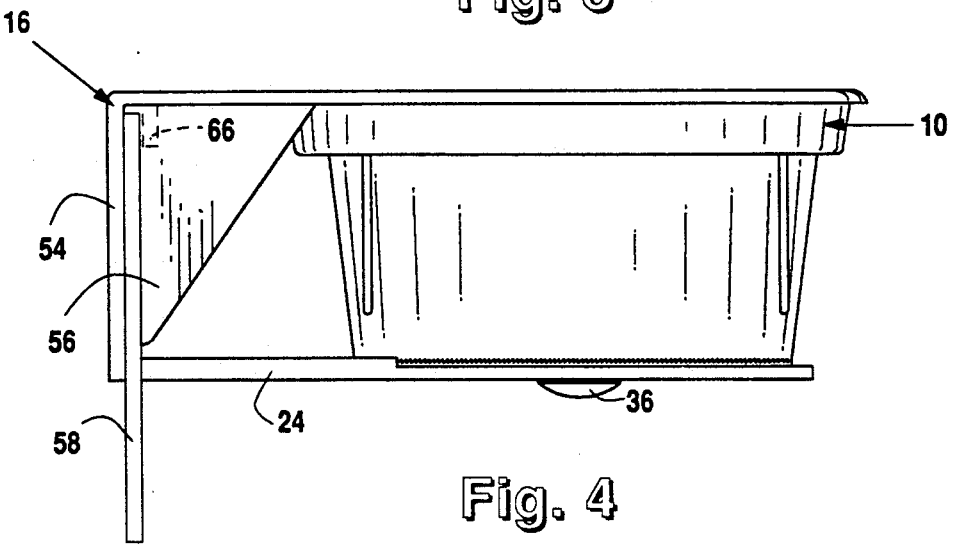
FIG. 4 is a rear view of the invention.

Referring now to FIG. 4, the plastic molded combination beverage holder and snack tray 10 is shown in a rear view as the invention may appear when the top and bottom hooks 22 and 24, the top hook 22 hidden from view by the bracing arm 16 and triangular struts 56, are securely fastened around the leg of a chair with vertical extension 58 in place between the vertical segment 54 and ridge 66.

Correct positioning of the beverage container holder and snack tray is necessary to ensure adequate and stable support for items and beverage containers placed in and on the beverage container holder and snack tray. In order to correctly position the beverage container holder and snack tray securely around the right front tubular leg of a chair, while seated in the chair the invention is held in the right hand, beverage container well towards the front, parallel with the seat of the chair. The rear of the tray is then sharply elevated such that the top hook is in front of the leg and just above the front cross-member of the seat, and the bottom hook is behind the leg and below the front cross-member of the seat. If the vertical extension piece is used, however, the top hook and the bottom hook are both above the front cross-member of the seat. Held in this position, the bottom hook is rotated toward the chair until both hooks are aligned with the leg. The rear of the tray is then lowered and the hooks fit securely around the leg. If the tray is not level, the rear of the tray is raised slightly, to relieve pressure, and the bottom hook is rotated forward, one tooth at a time until the tray is level. If at any time after attachment, the tray is higher than the beverage container holder, the bottom hook is rotated one complete clockwise turn and the initial procedure repeated.

I claim:

1. A molded beverage container holder and tray apparatus for attachment to a chair leg, comprising:

means for retaining a beverage container in a generally vertical position;

means for retaining a multiplicity of separate articles, connected to said beverage container retaining means;

means for attachment of said apparatus to said chair, connected to said beverage retaining means, wherein said attachment means further comprises a first stationary hook member and a second movable hook member, said first and second hook members vertically spaced, said first hook member being molded to a top section of said beverage container retaining means and said second movable hook member molded to a plate rotatably affixed to an underside of said beverage container retaining means;

means for maintaining said apparatus in a generally aligned position with said chair when said apparatus is attached to said chair, connected to said article retaining means.

2. A molded beverage container holder and tray apparatus for attachment to a chair leg, comprising:

means for retaining a beverage container in a generally vertical position;

means for retaining a multiplicity of separate articles, connected to said beverage container retaining means;

means for attachment of said apparatus to said chair, connected to said beverage retaining means, wherein said attachment means further comprises a first stationary hook member and a second movable hook member, said first and second hook members vertically spaced, said first hook member being molded to a top section of said beverage container retaining means and said second movable hook member molded to a plate rotatably affixed to an underside of said beverage container retaining means;

means for maintaining said apparatus in a generally aligned position with said chair when said apparatus is attached to said chair, connected to said article retaining means; and means for adjustment of the position of said second movable hook for engagement with said leg of said chair, said adjustment means further comprising a ratchet assembly movably joining said underside of said beverage container retaining means to top of said plate, said assembly allowing for only clockwise rotation of said second movable hook member.

3. The apparatus of claim 2, wherein:

said ratchet assembly further comprises a first set of teeth molded on said underside of said beverage retaining means and a second set of teeth molded on top of said plate such that selected sections of said first set of teeth cooperate with said second set of teeth to restrict counterclockwise movement of said second movable hook member.

4. A molded beverage container holder and tray apparatus for attachment to a chair leg, comprising:

means for retaining a beverage container in a generally vertical position;

means for retaining a multiplicity of separate articles, connected to said beverage container retaining means;

means for attachment of said apparatus to said chair, connected to said beverage retaining means;

means for maintaining said apparatus in a generally aligned position with said chair when said apparatus is attached to said chair, connected to said article retaining means, wherein said alignment maintaining means is an "L" shaped bracket assembly having a horizontal segment and a vertical segment, wherein said alignment maintaining means further comprises a first and second triangular strut molded to an underside of said "L" shaped bracket assembly, and wherein said alignment maintaining means further comprises an extension for said bracket assembly, said extension further comprises a flat rectangular sheet having two narrow vertical slots for engagement with said first and second struts, said first and second struts having a rectangular notch for engagement with said vertical slots, and a ridge on said underside of said bracket assembly wherein said extension fits between said ridge and said vertical segment of said bracket assembly.

* * * * *